United States Patent [19]

Bonvallet

[11] 4,129,245

[45] Dec. 12, 1978

[54] ACCELERATION COMPENSATED DEVICE FOR SKI BINDINGS

[76] Inventor: Duane J. Bonvallet, 605 S. Hickory Ridge Rd., Milford, Mich. 48042

[21] Appl. No.: 811,552

[22] Filed: Jun. 30, 1977

[51] Int. Cl.[2] ..... A63C 9/08

[52] U.S. Cl. ..... 280/628

[58] Field of Search ..... 280/628, 629, 632, 625

[56] References Cited

U.S. PATENT DOCUMENTS

| | | | |
|---|---|---|---|
| 2,846,232 | 8/1958 | Schnell | 280/625 |
| 3,348,855 | 10/1967 | Marker | 280/629 |
| 3,430,971 | 3/1969 | Berlenbach | 280/629 |
| 3,528,672 | 9/1970 | Wunder | 280/632 |
| 3,672,322 | 9/1972 | Frisch | 280/629 |
| 3,870,326 | 3/1975 | Cubberley | 280/628 |

*Primary Examiner*—Robert R. Song

*Attorney, Agent, or Firm*—Basile and Weintraub

[57] ABSTRACT

A ski binding having a retaining device which secures a skier's boot to a ski. The retaining device releases the boot when the lateral, longitudinal, and/or upward forces acting between the ski and the boot reach a predetermined level. The retaining device includes means which function to generate a force which is equal to and opposite to the force generated by the acceleration of the boot mass in the lateral and/or vertical directions so as to cancel out the internal forces resulting from such accelerations and thereby eliminate the premature release of the ski bindings.

7 Claims, 2 Drawing Figures

10
D1
D2

ACCELERATION COMPENSATED DEVICE FOR SKI BINDINGS

BACKGROUND OF THE INVENTION

I. Field of the Invention

The present invention relates to skiing apparatus and, more particularly, to an acceleration compensated device which releasably binds a skier's boot to his ski and functions to cancel out the forces generated by the boot mass during acceleration of the same. The term acceleration is often referred to as "shock" by those skilled in the art of releasable ski bindings — the ability of a ski binding to not release permaturely because of shock is referred to as its "anti-shock capability."

II. Description of the Prior Art

Much effort has been expended on the problem of safely securing a skier's boot to his ski with sufficient force to enable the skier to adequately control his skis while at the same time allowing the skier's boot to be released from the ski should the forces acting on his boot become great enough to injure him. The releasable ski binding which holds the skier's boot to the ski must allow for release of the skier's boot in the horizontal plane, including moments which tend to twist the skier's boot, and in a vertical plane when forces tend to lift the skier's boot. The importance of ski bindings has become more important as developments in ski boot construction, such as molded plastic inserts, have provided even more rigid positioning of the skier's foot within the ski boot and thereby tend to increase the danger of serious injury if the boot is not properly released from the ski. Present-day ski bindings include a resistance element, such as a spring, which determines the force required before the skier's boot will be released from the binding. This requirement must be met if the safety ski binding is to accomplish its objective of protecting the skier from typical skiing injuries. Thus, any shocks having an energy level in excess of the predetermined shock work absorption capacity of the ski binding holding device will automatically result in a release of the ski boot, whether or not significant leg forces are present.

It should be realized that in practice most shocks are encountered while skiing on rough snow, chatter bumps, moguls and the like. The two significant types of forces acting on the ski bindings (the external forces imposed by the skier's legs and the internal forces generated by the acceleration of the boot mass) are additive; and in order to prevent the inadvertent release of the bindings, most bindings must be set to accommodate both forces simultaneously. Thus, in a typical retaining device the release force and resulting moment must be set so high that they are sufficient to fracture a leg when a non-violent fall occurs since the acceleration forces do not develop. It would therefore be desirable to provide a ski boot retaining device which functions to cancel the forces generated by the boot mass during acceleration and release only as a result of the external forces from the skier's legs.

Applicant is aware of the following Letters Patents which are relevant to applicant's invention: U.S. Pat. No. 3,692,322; No. 2,846,232; No. 3,528,672; No. 3,430,971; and No. 3,348,855. These patents relate broadly to the concept of ski bindings and devices which releasably bind a skier's boot to his ski; but, in the opinion of applicant, these patents do not disclose nor in any manner suggest applicant's invention.

III. Prior Art Statement

In the opinion of the applicant, the aforementioned United States Letters Patents represent the closest prior art of which applicant is aware.

SUMMARY OF THE INVENTION

The present invention, which will be described subsequently in greater detail, comprises an acceleration compensated ski boot retaining device for releasably securing a skier's boot to a ski. The acceleration compensated ski boot retaining device comprises a pivot member adapted to engage a portion of the ski boot. The pivot member is pivotally carried such that the ski boot engaging portion of the pivot member pivots on one side of a pivot plane. The device further comprises a mass having means connecting the mass to the pivot member such that the center of gravity of the mass is on the other side of the pivot plane. The mass is sized to generate a moment at the pivot plane which is equal to and opposite to the moment generated by the boot mass during lateral and/or vertical accelerations of the boot to thereby cancel out internal acceleration forces acting against the retaining device.

It is therefore a primary object of the present invention to provide an acceleration compensated ski boot retaining device adapted to generate a moment at the pivot plane equal to and opposite to the moment generated by the boot mass during acceleration of the boot in either a lateral or a vertical direction whereby only the forces imposed by the skier's leg will cause the binding to release.

It is a further object of the present invention to provide such an acceleration compensated ski boot retaining device which may be safely adjusted by the wearer to release at forces less than bone fracture forces without experiencing inadvertent release due to acceleration or shock loads acting on the ski bindings.

It is a further object of the present invention to provide such a retaining device which is simple in its construction and design and, thus, one which is inexpensive to manufacture and maintain.

It is yet a further object of the present invention to provide an acceleration compensated ski boot retaining device having general principles of construction which are applicable to many of the different types of ski boot binding designs that are commercially available.

Other objects, advantages and applications of the present invention will become apparent to those skilled in the art of releasable ski bindings when the accompanying description of one example of the best mode contemplated for practicing the invention is read in conjunction with the accompanying drawing. The best mode contemplated is one in which the invention is configured to releasably bind the boot to the ski with the acceleration sensitive mechanism located at the toe. The invention can be configured to locate the acceleration sensitive mechanism at the heel, both the toe and heel, or between the boot sole and the ski.

BRIEF DESCRIPTION OF THE DRAWING

The description herein makes reference to the accompanying drawing wherein like reference numerals refer to like parts throughout the several views, and wherein.

DESCRIPTION OF THE PREFERRED EMBODIMENT

Figures 1, 2:
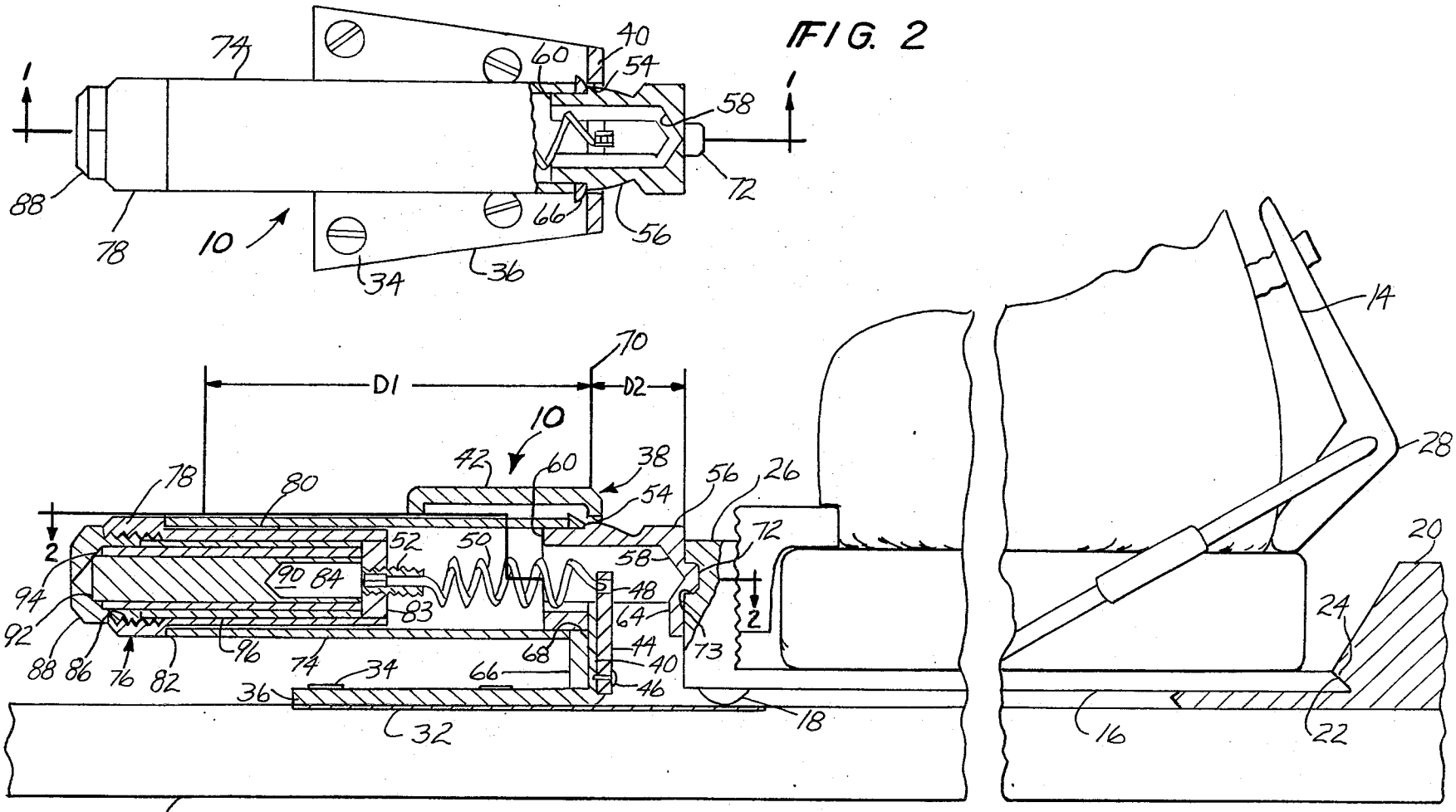
FIG. 1 is a longitudinal, partially sectioned side elevational view of a ski and ski binding having an acceleration compensated ski boot retaining device fabricated in accordance with the principles of the present invention and taken along Line 1—1 of FIG. 2.
FIG. 2 is a fragmentary, partially sectioned top elevational view of the acceleration compensated ski boot retaining device illustrated in FIG. 1 and as seen from Line 2—2 thereof.

Referring now to the drawing and, in particular, to FIG. 1 wherein there is illustrated one example of the present invention in the form of an acceleration compensated ski boot retaining device 10 mounted to the upper surface of a conventional ski 12 for the purpose of releasably securing a ski boot 14 to the ski 12. The skier's boot 14 rests on a boot plate 16, the boot plate 16 being securely attached to the skier's boot 14 in a conventional manner. The boot plate 16 has an anti-friction bar 18 at its forward end such that the boot plate 16 and, thus, the skier's boot 14 rest on top of the ski 12 and are held in position on the top of the ski 12 by means of a releasable ski binding which includes a toe-holding assembly in the form of the retaining device 10 and a heel-holding mechanism 20. The heel-holding mechanism 20 includes a recess 22 which slidably engages a side ramp 24 formed on the rear portion of the boot plate 16. The forward portion of the boot plate 16 has a toe plate 26 which engages the ski boot near the toe portion of the same and, in conjunction with binding 28, functions to securely attach the boot 14 to the boot plate 16.

The toe release device 10 comprises an anti-friction pad 32 which is secured to the top of the ski 12 by any suitable means, such as threaded fasteners 34, that extend through suitable apertures in a toe piece base plate 36 and the anti-friction pad 32 and into engagement with the ski 12. The toe piece base plate 36 forms one portion of a generally U-shaped housing 38 which includes a vertical leg 40 and a lateral top portion 42. The housing 38 generally functions to mount the working portions of the release device 10, as well as to secure the device 10 to the ski in a spaced relationship with the heel-holding mechanism 20, such that the boot 14 may be inserted thereinbetween and secured in a manner to be described hereinafter. The vertical leg 40 of the housing 38 supports a spring post 44 by means of a fastening member 46 that extends laterally through the lower portion of the spring post 44 and into engagement with a threaded bore in the vertical leg 40. The spring post 44 has a grooved portion 48 at its upper end which is sized to securely receive one end of a coiled spring 50, the opposite end of which is attached to a spring screw 52, the purpose of which will be described hereinafter. The vertical leg 40 is provided with a circular aperture 54 through which a toggle pivot member 56 extends. The toggle pivot member 56 has a blind bore 58 extending from its inside surface 60 which accommodates the spring 50. The toggle pivot member 56 further comprises a slotted portion 64 which functions to permit the toggle pivot member 56 to be inserted through the vertical leg aperture 54 to the position illustrated such that the spring post 44 projects upwardly and into the central regions of the blind bore 58.

The release device 10 further comprises a toggle plate 66 which is of a rectangular shape having a height somewhat longer than its width. The toggle plate 66 has a central aperture 68 through which the cylindrical end portion 60 of the toggle pivot member 56 is received such that the toggle pivot member 56 and the toggle plate 66 move as one unit and pivot about the pivot plane defined by the line 70. Thus, the toggle pivot member 56 and the toggle plate 66 are so mounted to the U-shaped housing 38 that the toggle pivot member 56 and its associate toggle plate 66 may pivot about a vertical axis such that the pivot member is pivoting in a horizontal plane, or the toggle pivot member 56 may pivot together with the pivot plate about a horizontal axis such that the toggle pivot member 56 is moving through a vertical plane. The toggle pivot member 56 further comprises a toggle pin 72 which is sized to be received in a recess 73 formed in the front face of the toe plate 26 so as to secure the boot plate 16 and, thus, the boot 14 to the ski in the conventional manner.

The toggle plate 66 and the toggle pivot member 56 are maintained in the position illustrated; that is, the toggle plate 66 bears against the inside surface of the vertical leg 40 of the housing 38 by means of pressure exerted against the toggle plate 66 from the coil spring 50. The force of the spring 50 is brought to bear against the toggle plate 66 by means of a mass support tube 74 which has its inner end bearing directly against the toggle plate 66, while its outer end is in abutment with a spring tension adjuster 76. The tension adjuster 76 has an outer cylindrical grip 78 and an inner tubular portion 80 which define at their juncture a shoulder 82 which is sized to receive the outer end of the mass support tube 74. The inner end of the cylindrical tube 80 receives a spring support 83 which is provided with a central threaded bore 84 that receives the aforementioned spring screw 52. It can thus be seen upon inspecting FIG. 1 that the spring 50, when expanded, exerts a force urging the mass support tube 74 into engagement with the toggle plate 66. This is accomplished through the spring 50 acting to pull the cylindrical spring tension adjuster 76 into compression against the mass support tube 74. It can also be seen that when the cylindrical grip 78 is rotated, the spring support 83 will turn relative to the spring screw 52. When the cylindrical grip 78 is rotated clockwise, the spring screw 52 will be threaded into and through the spring support 83, thereby increasing the spring force of the coil spring 50 that is exerted against the toggle plate 66. Conversely, when the cylindrical grip 78 is rotated in a counterclockwise direction, the spring support 83 is moved relative to the spring screw 52 so as to withdraw the same from the threaded bore 84 and thereby decrease the tension of the spring 50 acting on the toggle plate 66. This functions to permit the user of the ski boot retaining device 10 to control the amount of force which must be overcome in order for the ski boot to be released from the release device 10, all of which will be described in greater detail hereinafter.

The interior surface of the cylindrical grip 78 is threaded at 86 to receive a threaded end plug 88 so as to enclose the interior of the spring tension adjuster 76. The interior 90 of the tension adjuster 76 is adapted to receive a plurality of concentric masses 92, 94 and 96. The weight of the masses and their number are determined by the mass of the boot 14, as will be described hereinafter.

The invention, as disclosed, overcomes the aforementioned problems encountered by the skier when skiing on rough snow, chatter bumps, moguls or during the aggresive maneuvering of a race. As aforementioned, the two significant forces acting on a ski binding are the external forces imposed by the skier's legs and the internal forces generated by the acceleration of a boot mass. The average skier must adjust his bindings so as to prevent their inadvertent release which may occur due to the simultaneous acting of the internal and external forces on the bindings. As aforementioned, this combined force results in the skier having to adjust his bindings with a release force (and resulting moment) which may be sufficient to fracture a leg in the event of a non-violent fall where the acceleration forces do not develop, and therefore the ski boots do not separate from the ski bindings.

It is believed that the aforementioned problem is overcome by applicant's invention. Due to its unique construction, the internal acceleration forces are canceled. The boot plate 16 is held in position by the heel-holding mechanism 20 and the toggle pin 72 at the front of the boot plate 16. The coil spring 50 preloads the toggle pivot member 56 against the toggle plate 66 such that upward and lateral release of the boot toe occurs when the respective forces acting on the toggle pivot member 56 become great enough to pivot the spring loaded toggle pivot member 56. The dimensions of the rectangular toggle plate 66 establish the vertical to lateral release ratio, which in this preferred embodiment is approximately 2.4 to 1. The vertical heel removal is achieved by the side ramp 24 at the rear of the boot plate 16 forcing the plate upward or forward against the spring 50. Straight forward release occurs when the forward force exceeds the longitudinal spring force of a coil spring 50.

The unique feature of applicant's invention is that the concentric masses 92, 94 and 96 function to generate a moment at the pivot plane 70 which is equal to and opposite to the moment generated by the boot mass during acceleration, whether lateral or vertical. Complete cancellation of the internal acceleration forces is achieved by the proper selection of mass (92 and 94 and/or 96) and dimensions D1 and D2. When the moments are in balance, the internal forces due to acceleration are eliminated as a cause of binding release; and the only forces that can cause binding release in the instant design are the external forces; that is, those imposed by the skier's legs. Thus, the binding of applicant's invention may be safely adjusted to release at forces less than the bone fracture forces without experiencing the inadvertent release due to shock loads.

It can thus be seen that applicant's invention has disclosed a new and improved accleration compensated ski boot release device which is simple in its design and construction and which can be manufactured in such a manner that applicant's unique invention may be easily adapted to other forms of commercially available ski bindings. To this end, it should be understood by those skilled in the art of ski bindings that other forms of applicant's invention may be had, all coming within the spirit of the invention and scope of the appended claims.

What is claimed is as follows:

1. An acceleration compensated ski boot release device for a safety ski binding, said device comprising:

a support member adapted to be mounted to a ski;

a pivot member having a first portion adapted to engage a portion of said ski boot, said pivot member being pivotally carried by said support member for movement about a pivot point such that said first portion is disposed on one side of said pivot point;

a mass;

means connecting said mass to said pivot member such that said mass and said pivot member pivots about said pivot point as a rigid unit and such that the center of gravity of said mass is disposed on the other side of said pivot point, said mass being so sized and located as to generate a moment at the pivot point equal to and opposite to a moment generated by the boot mass during acceleration of said boot to cancel the internal acceleration forces generated by said boot mass.

2. The device defined in claim 1 further comprising resilient means for urging said first portion into engagement with said boot portion.

3. The device defined in claim 2 further comprising fulcruming means connected to said pivot member, said fulcruming means having two side surfaces, said fulcruming means coacting with said resilient means to urge said first portion into operative engagement with said boot portion, said support member providing a fulcruming surface for said fulcruming means, said fulcruming means being dimensioned to provide a ratio of fulcrum effect against vertical and lateral displacement of said first portion of said pivot member.

4. The device defined in claim 2 wherein said resilient means comprises a coil spring having one end carried by said support member;

a longitudinal spacer means coacting with said pivot member and biasing said pivot member toward said boot portion;

spring tension adjustment means coacting with said longitudinal spacer means to urge said spacer means toward said pivot member, said spring tension adjustment means having a threaded bore; and a spring screw threadingly engaging said threaded bore, said coil spring having one end carried by said spring screw such that, as said spring tension adjustment means is rotated relative to said longitudinal spacer means, the force of said spring is varied, and thus the amount of force urging said pivot member toward said boot portion may be varied.

5. The device defined in claim 3 wherein said resilient means comprises a coil spring having one end carried by said support member;

a longitudinal spacer means coacting with said pivot member and biasing said pivot member toward said boot portion;

spring tension adjustment means coacting with said longitudinal spacer means to urge said spacer means toward said pivot member, said spring tension means having a threaded bore; and a spring screw threadingly engaging said threaded bore, said coil spring having one end carried by said spring screw such that, as said spring tension adjustment means is rotated relative to said longitudinal spacer means, the force of said spring is varied, and thus the amount of force urging said pivot member toward said boot portion may be varied.

6. The acceleration compensated ski boot release device defined in claim 1 wherein means are provided for varying said mass.

7. The acceleration compensated ski boot release device defined in claim 1 comprising longitudinal spacer means operatively connected to said resilient means for biasing said pivot member toward said boot portion;

a container means carried by said longitudinal spacer means;

cap means for providing access to the interior of said container means; and a plurality of preselected masses disposable in a concentric relationship within said container means and selectively removable therefrom to provide a variable mass functioning to cancel said acceleration forces.

* * * * *